US008702289B2

(12) United States Patent
Sato et al.

(10) Patent No.: US 8,702,289 B2
(45) Date of Patent: Apr. 22, 2014

(54) LIGHTING UNIT

(75) Inventors: Takashi Sato, Tokyo (JP); Takao Saito, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 340 days.

(21) Appl. No.: 13/286,203

(22) Filed: Oct. 31, 2011

(65) Prior Publication Data

US 2012/0140507 A1 Jun. 7, 2012

(30) Foreign Application Priority Data

Oct. 29, 2010 (JP) ..... 2010-243070
Nov. 9, 2010 (JP) ..... 2010-250479

(51) Int. Cl.
*F21V 33/00* (2006.01)

(52) U.S. Cl.
USPC ..... 362/538; 362/84; 362/260; 362/259; 362/319

(58) Field of Classification Search
USPC ..... 362/538, 539, 507, 84, 60, 259, 319, 362/324, 325
See application file for complete search history.

(56) References Cited

U.S. PATENT DOCUMENTS 7,165,871 B2 * 1/2007 Takeda et al. ..... 362/538
2011/0044070 A1 * 2/2011 Takahashi ..... 362/553
2011/0157865 A1 * 6/2011 Takahashi et al. ..... 362/84

FOREIGN PATENT DOCUMENTS

JP 4047266 B2 2/2008

* cited by examiner

*Primary Examiner* — Laura Tso
(74) *Attorney, Agent, or Firm* — Kenealy Vaidya LLP

(57) ABSTRACT

A lighting unit can form a plurality of light distribution patterns without use of a shield and without an act of shielding light from a light source. The lighting unit can include a laser diode, a fluorescent member with a fluorescent portion configured to receive blue light from the laser diode and emit white light, and a projector type lens configured to project the white light. The fluorescent member can be rotated around a rotation shaft perpendicular to the optical axis of the projector type lens and shaped such that when the fluorescent member is rotated by a predetermined angle by the driving member and viewed from the projector type lens, a plurality of contours of the fluorescent portion can be changed according to the predetermined angle.

25 Claims, 13 Drawing Sheets

LIGHTING UNIT

This application claims the priority benefit under 35 U.S.C. §119 of Japanese Patent Application No. 2010-243070 filed on Oct. 29, 2010 and Japanese Patent Application No. 2010-250479 filed on Nov. 9, 2010, which are hereby incorporated in their entireties by reference.

TECHNICAL FIELD

The presently disclosed subject matter relates to a lighting unit.

BACKGROUND ART

A conventional lighting unit for use in, for example, a vehicle headlight is disclosed in Japanese Patent No. 4047266 (or U.S. Pat. No. 7,165,871B), in which a semiconductor light emitting device and a fluorescent material are used in combination. The lighting unit disclosed in this patent document can be configured such that the fluorescent material is excited by the light from the semiconductor light emitting device to emit visible light and the visible light is reflected by a reflector forward to form a predetermined light distribution pattern.

However, the above conventional lighting unit form a single light distribution pattern because the light emission performance of the fluorescent material and the reflection performance of the reflector and the like are constant.

To cope with this, a plurality of fluorescent materials formed like a color wheel are utilized to be switched for forming a plurality of different light distribution pattern. With this configuration, unintended light may leak from areas between the plurality of fluorescent materials. The leakage light is typically shut down by shielding the areas between the plurality of fluorescent materials. This requires an additional shielding member or the like. However, when such a shielding member is disposed so as to be capable of shielding leakage light, the shielding member may be heated by the light from the semiconductor light emitting device with high luminous flux density, resulting in heat deformation. In view of this, the light from the semiconductor light emitting device is desired to always be concentrated onto the fluorescent material without shielding. However, in this case, the separate fluorescent materials may not be effectively irradiated with the light, meaning that the light from the semiconductor light emitting device cannot be utilized with a high utilization rate. Accordingly, both the case with the light shielding member and the case without the light shielding member can have certain problems.

SUMMARY

The presently disclosed subject matter was devised in view of these and other problems and features and in association with the conventional art. According to an aspect of the presently disclosed subject matter, there is provided a lighting unit that can form a plurality of types of light distribution patterns without shielding the light from a semiconductor light emitting device.

According to another aspect of the presently disclosed subject matter, there is provided a lighting unit that can include: a light source including a semiconductor light emitting device; a fluorescent member including a fluorescent portion that can receive part of or all of light emitted from the light source and emit visible light with a predetermined color; a projector type lens having an optical axis on or near which the fluorescent member is disposed, the projector type lens configured to project the visible light emitted from the fluorescent member forward in a direction of the optical axis; and a driving member connected to the fluorescent member, so as to rotate the fluorescent member around a rotation shaft perpendicular to the optical axis of the projector type lens. In this lighting unit with the above structure, the fluorescent member can be shaped such that when the fluorescent member is rotated by a predetermined angle by the driving member and viewed from the projector type lens a plurality of contours of the fluorescent portion can be changed according to the predetermined angle.

According to the configuration made in accordance with the presently disclosed subject matter, a plurality of light distribution patterns can be formed by only rotating the fluorescent member by a predetermined angle without shielding the light from the light source.

In the above aspect, the fluorescent member can mainly be composed of the fluorescent portion, and when the fluorescent member is rotated by a predetermined angle position around the rotation shaft thereof, the fluorescent member can receive the light (excitation light) from the light source to emit light with the contour of the fluorescent portion at the predetermined angle position for projection, thereby forming a plurality of light distribution patterns.

In accordance with this configuration, the outer shape of the fluorescent member composed of the fluorescent portion can have an appropriate form, and various projection images of light at the respective predetermined angle positions can form corresponding light distribution patterns. Accordingly, with such a simple configuration and operation, a plurality of clear light distribution patterns can be formed.

The lighting unit with the above configuration can further include a flexible mirror configured to move in a predetermined moving direction, the flexible mirror having a variable reflecting surface that can have a surface with variable radius of curvature varied in the moving direction, the flexible mirror disposed on a light path from the light source to the fluorescent member so that the light emitted from the light source is reflected by the variable reflector to the fluorescent member.

By this configuration, when the flexible mirror moves, the position of the variable reflecting surface where the excitation light from the light source impinges can be changed to another position where the radius of curvature is different from that at the previous position. In this manner, the reflecting state of the flexible mirror can be changed to change the irradiated region of the fluorescent member by the excitation light. The changed irradiated region of the fluorescent member to be irradiated with the excitation light can change the brightness distribution of visible light that is emitted from the fluorescent member, thereby providing a light distribution pattern with different luminance distribution.

The lighting unit with the above configuration can further include a reflecting mirror disposed around the fluorescent member except for a portion where the visible light from the fluorescent member travels to the projector type lens and having a reflecting inner surface concentric with the fluorescent member.

With this configuration, the visible light emitted from the fluorescent member toward a region other than the direction toward the projector type lens and the excitation light passing through the fluorescent member can be returned by the reflection by the reflecting surface so that the light can impinge on the fluorescent member again to become visible light toward the projector type lens. This can improve the light flux utilization efficiency.

Alternatively, in the above aspect of the presently disclosed subject matter, the fluorescent member can include a fluorescent portion including a plurality of fluorescent portions with respective different shapes disposed at a plurality of angle positions around its rotation shaft, and when the fluorescent member is rotated around the rotation shaft at one of the plurality of angle positions so that corresponding one of the fluorescent portions faces to the projector type lens. In this state, the corresponding fluorescent portion can receive light from the light source and emit light so that the light with a contour of the fluorescent portion at that angle position can be projected to provide a corresponding one of the light distribution patterns.

Namely, any one of the fluorescent portions that faces towards the projector type lens can receive the excitation light from the light source so that the irradiated fluorescent portion can emit visible light to be projected forward in front of the vehicle via the projector type lens. At that time, the one of the plurality of fluorescent portions can be disposed on the optical axis of the projector type lens when it is rotated at one of the predetermined angle positions. Namely, the plurality of fluorescent portions can be disposed on the peripheral surface of the fluorescent member (or rotation member), which can rotate around its rotation shaft perpendicular to the optical axis of the projector type lens, in the peripheral direction. In accordance with the principle of the presently disclosed subject matter, the fluorescent portions can have a different contour (shape) each when viewed from its front. When the fluorescent member (rotation member) is rotated by the driving member, any one of the fluorescent portions with different shapes can be placed behind the projector type lens, meaning that visible light with different light distribution patterns corresponding to the different shapes can be projected through the projector type lens. Accordingly, without shielding (shaping) the light from the semiconductor light emitting device of the light source, a plurality of light distribution patterns can be formed simply by rotating the rotation member or the fluorescent member.

In the lighting unit with the above configuration, the plurality of fluorescent portions can have respective surfaces with a recess and/or a convex so that the excitation light from the light source can impinge by a sharper angle on a portion of the surface from which light is emitted to form part of the light distribution pattern with higher luminance required.

With the above configuration, a desired light distribution pattern can be formed in accordance with the luminance distribution corresponding to the surface shape of the fluorescent portion. Accordingly, by appropriately forming the surface shape of each of the fluorescent portions, a plurality of desired light distribution patterns with desired respective luminance distributions can be formed.

In the lighting unit with the above configuration, the semiconductor light emitting device can be a laser diode.

In the lighting unit with the above configuration, the fluorescent member can include a diffusion material.

Furthermore, the lighting unit may be a vehicle headlight. In this case, the contours or the shapes of the fluorescent member can be similar figures corresponding to a low-beam light distribution pattern and a high-beam light distribution pattern for a vehicle headlight in accordance with each domestic regulation for a vehicle headlight.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to exemplary lighting units of the presently disclosed subject matter with reference to the accompanying drawings in accordance with exemplary embodiments.

Figure 1:
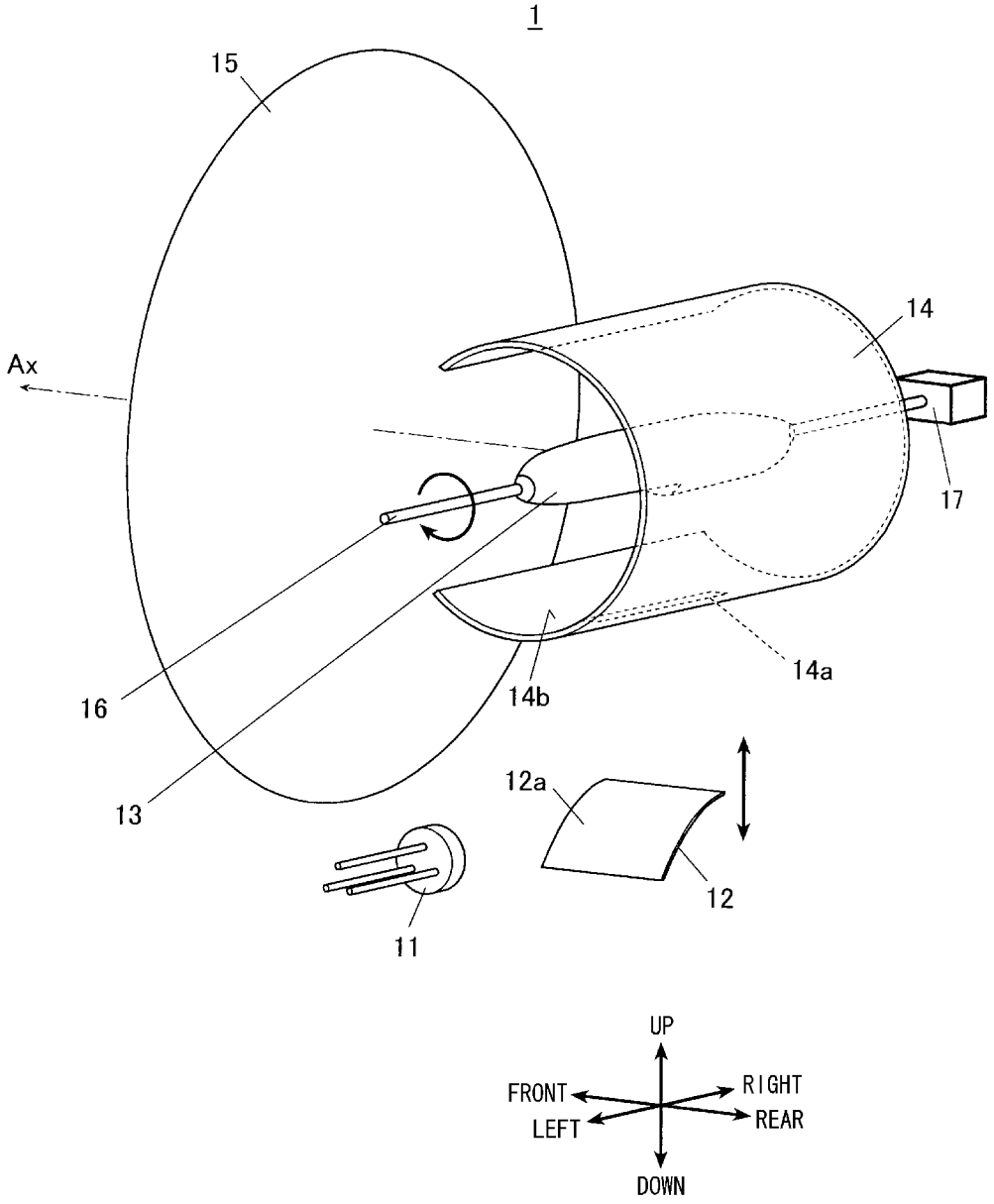
FIG. 1 is a perspective view showing portions of a lighting unit according to a first exemplary embodiment made in accordance with principles of the presently disclosed subject matter.

FIG. 1 is a perspective view showing portions of a lighting unit 1 according to an exemplary embodiment made in accordance with principles of the presently disclosed subject matter.

The lighting unit 1 can be a vehicle headlight installed in a vehicle, for illuminating a road surface in front of the vehicle, as an example. It should be noted that FIG. 1 shows the lighting unit disposed at a predetermined position, and the directions (front, rear, right, left, up and down) are based on this state of the lighting unit. Further, in order to clearly understand the components of the presently disclosed subject matter, typical supporting members, housings and the like for supporting and positioning the components are omitted in the drawings.

As shown in FIG. 1, the lighting unit 1 can include a laser diode 11 (hereinafter, referred to as an "LD"), a flexible mirror 12, a fluorescent member 13, a reflecting mirror 14, a projector type lens 15 having an optical axis Ax, a driving member (such as an actuator) 17, and the like.

The LD 11 can be a semiconductor light emitting device and, for example, can emit blue laser light as excitation light for the fluorescent member 13. In this exemplary embodiment, the LD 11 can emit light in a width direction of the vehicle (right-to-left direction).

The flexible mirror 12 can be disposed below the fluorescent member 13 and rightward with respect to the LD 11. The flexible mirror 12 can have a reflecting surface 12*a* composed of a curved surface. The blue light emitted from the LD 11 can be reflected off the reflecting surface 12*a* so that the above fluorescent member 13 is irradiated with the light. The flexible mirror 12 can be configured to be movable by appropriate control so as to change the reflection state. Specifically, the flexible mirror 12 can be configured to be movable in a vertical direction and the radius of curvature of the reflecting surface 12*a* along the width direction (right-to-left direction perpendicular to the front-to-rear direction) where the light is reflected can be changed corresponding to the vertical movement of the mirror 12. With this configuration, when the flexible mirror 12 is moved vertically, the portion of reflecting surface 12*a* where the blue light from the LD 11 can impinge can be shifted to utilize the radius of curvature at that portion, whereby the irradiation region in the width direction of the blue light to be reflected upward can be changed.

Figure 2A:
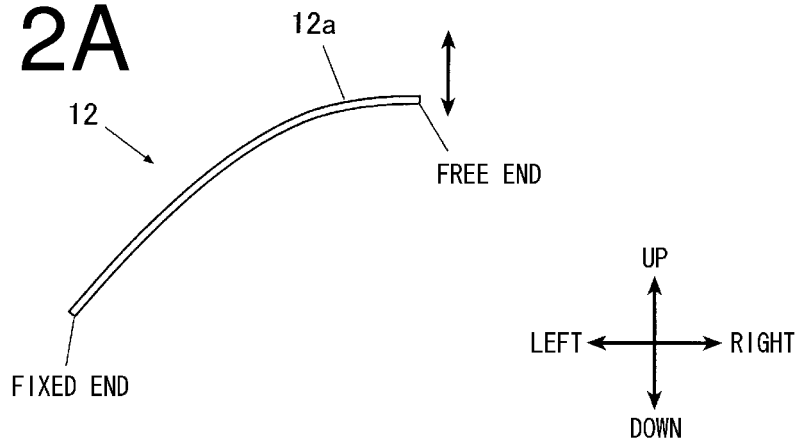
FIGS. 2A, 2B, and 2C are sectional views each showing a variation of a flexible mirror for use in the lighting unit according to the exemplary embodiment of FIG. 1.
Figure 2B:
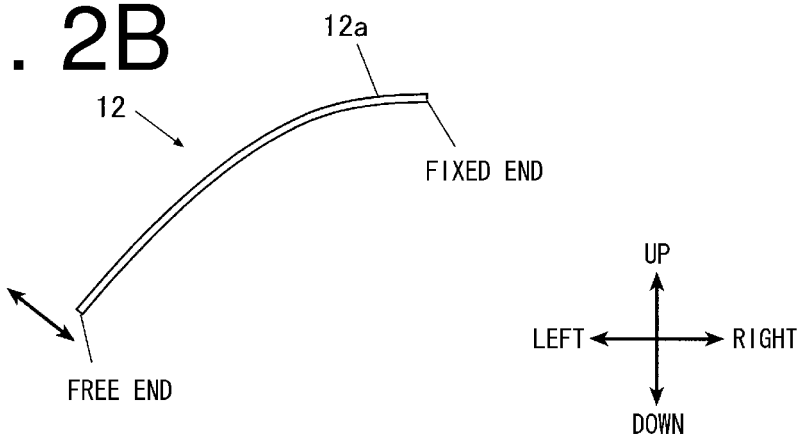
Figure 2C:
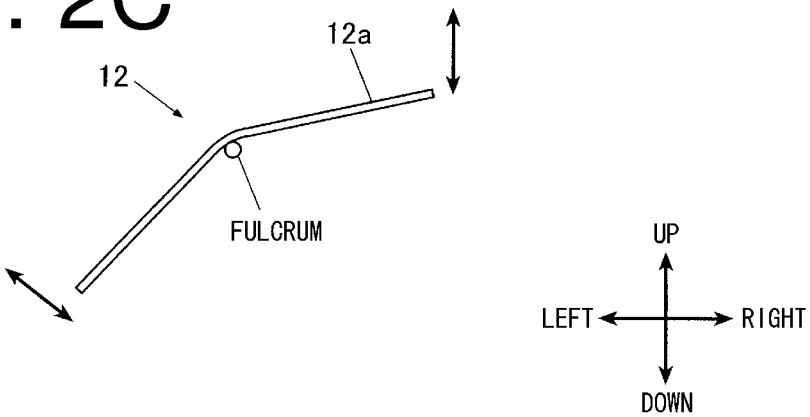

The flexible mirror 12 can take other shapes as shown in FIGS. 2A to 2C. FIGS. 2A and 2B show one variation of the flexible mirror wherein one end is fixed and the other end is freely moved (rotated), for example, along an arrow. FIG. 2C shows another variation of the flexible mirror wherein a predetermined axis parallel to the optical axis Ax of the projector type lens 15 is used as a fulcrum and both ends can be moved to continuously change the radius of curvature in a symmetrical line with the fulcrum as a center.

The fluorescent member 13 can function as a light distribution control member configured to form a plurality of light distribution patterns.

Figure 3A:
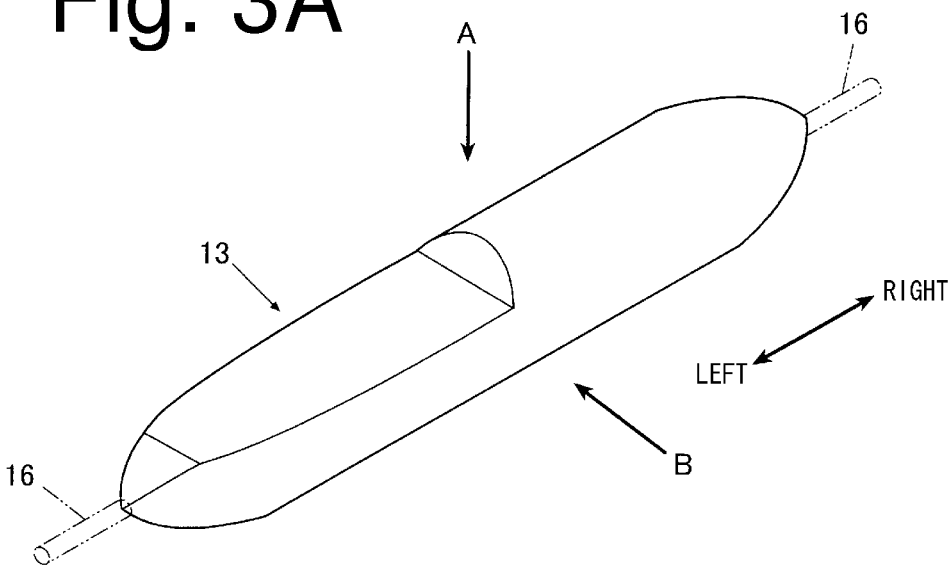
FIGS. 3A, 3B, and 3C are a perspective view of a fluorescent member in the lighting unit according to the exemplary embodiment of FIG. 1, a plan view when viewed from arrow A in FIG. 3A, and a plan view when viewed from arrow B in FIG. 3A, respectively.
Figure 3B:
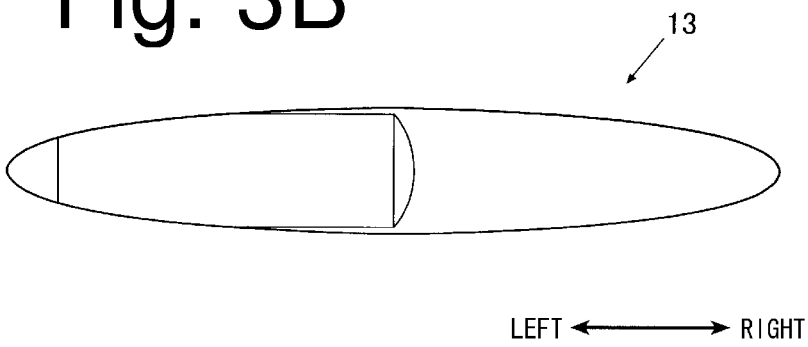
Figure 3C:
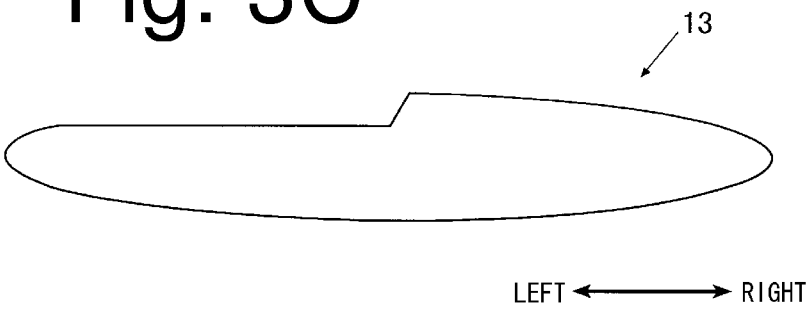

FIGS. 3A, 3B, and 3C are a perspective view of the fluorescent member 13, a plan view when viewed from arrow A in FIG. 3A, and a plan view when viewed from arrow B in FIG. 3A, respectively. As shown, the fluorescent member 13 of the present exemplary embodiment can have an elongated shape in the width direction. Specifically, the fluorescent member 13 of the present exemplary embodiment can be formed such that, when viewed from the direction A perpendicular to the width direction, the contour (or a shape of the image to be projected) can be an ellipse elongated in the width direction and such that, when viewed from the direction B perpendicular to both the direction A and the width direction, the contour (or a shape of the image to be projected) can be an ellipse elongated in the width direction and cut partially at left upper portion. More specifically, the contour of the fluorescent member 13 when viewed from the direction A (shape to be projected) can be a similar figure to the shape obtained by inverting the shape of a high-beam light distribution while the contour of the fluorescent member 13 when viewed from the direction B (shape to be projected) can be a similar figure to the shape obtained by inverting the shape of a low-beam light distribution. Herein, the dimension of the fluorescent member 13 can be a size such that the fluorescent member 13 is in contact with the inner wall of a cylinder with a 1 mm diameter and a 6 mm length, for example.

The fluorescent member 13 can be mainly formed from a fluorescent material that can emit, for example, yellow light as a result of excitation by blue light emitted from the LD 11. Accordingly, when the fluorescent member 13 receives the blue light, the blue light diffused by the fluorescent member 13 and the yellow light generated by exciting the fluorescent member 13 can be mixed to be radially emitted as a white light by the color addition. Examples of the fluorescent material for use in the fluorescent member 13 include a YAG (Yttrium Aluminum Garnet) with a rare earth added, and various common fluorescent materials.

Further, the fluorescent member 13 can include a diffusion material for diffusing blue light emitted from the LED 11. Examples of the diffusion material include calcium carbonate, titanium oxide, alumina, and the like. The fluorescent member 13 of the present exemplary embodiment can be formed by mixing a fluorescent material, and if necessary, a diffusion material with a binder such as a resin, and integrating them by sintering. The sintering provides a high level of durability and heat resistance.

The fluorescent member 13 can be configured to be rotatable around a rotation shaft 16 extending in the width direction. The rotation shaft 16 may or may not penetrate the fluorescent member 13, and, for example, a pair of rotation shaft parts can extend from both widthwise ends of the fluorescent member 13 so that the extended line thereof can pass through the center of the fluorescent member 13. The rotation shaft 16 can serve as a heat dissipation member for dissipating heat generated due to Stokes' loss of the fluorescent material. In order to do so, the rotation shaft (parts) 16 can be made of a metal with a high heat conductivity, such as copper and aluminum. To the tip end of the rotation shaft 16, an actuator configured as a driving member 17, such as a stepping motor for controlling the rotation angle can be connected.

The reflecting mirror 14 shown in FIG. 1 can be a cylindrical mirror having a larger diameter than the fluorescent member 13 and an elongated shape in the width direction of the vehicle. The reflecting mirror 14 can be configured to have its center axis coinciding with the rotation axis 16 so that the fluorescent member 13 can be covered with the reflecting mirror 14. The reflecting mirror 14 can have a front opening through which white light can be projected from the fluorescent member 13 to the front projector type lens 15. At the lower part of the reflecting mirror 14, there can be formed a passing slit 14*a* that allows the blue light reflected by the flexible mirror 12 to pass therethrough. Namely, the cylindrical reflecting mirror 14 can cover the fluorescent member 13 therearound except for the front opening portion and/or passing slit. The inner cylindrical surface of the reflecting mirror 14 can be a reflecting surface 14*b*. The reflecting surface 14*b* can be configured so that the center axis thereof coincides with the rotation shaft 16. The reflecting mirror 14 can reflect at its reflecting surface 14*b* the blue light diffused by the fluorescent member 13 and the yellow light emitted from the fluorescent member 13.

The projector type lens 15 has the optical axis Ax in the front-to-rear direction, on which the fluorescent member 13 is positioned. The projector type lens 15 can be disposed in front of the fluorescent member 13 and the reflecting mirror 14. The projector type lens 15 can have a rear focal point positioned at or near (i.e., substantially at) the fluorescent member 13. With this configuration, the white light emitted from the fluorescent member 13 forward can be projected forward through the projector type lens 15 while the shape of the image of the fluorescent member 13 is inverted vertically and horizontally by the projector type lens 15.

Figure 4:
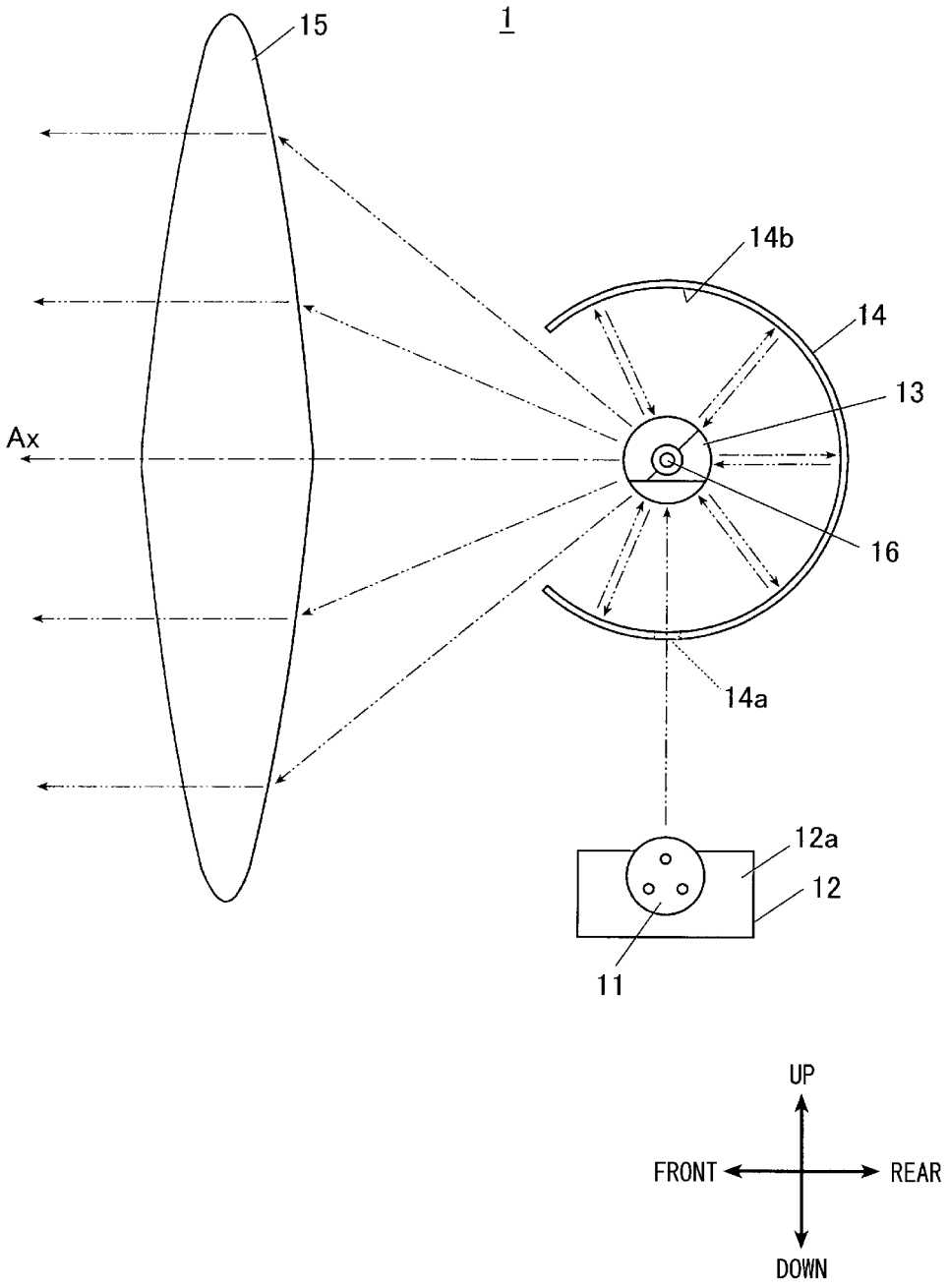
FIG. 4 is a side view illustrating the light path in the lighting unit according to the exemplary embodiment of FIG. 1.

FIG. 4 is a side view illustrating the light path in the lighting unit 1 according to the exemplary embodiment of FIG. 1.

As shown in the drawing, the lighting unit 1 can be configured such that the blue light (or excitation light) emitted from the LD 11 can be reflected off the reflecting surface 12*a* of the flexible mirror 12, pass through the passing slit 14*a* of the reflecting mirror 14, and impinge on the fluorescent member 13. When entering the fluorescent member 13, the blue light can be diffused in the fluorescent member 13 and part thereof can excite the fluorescent material in the fluorescent member to generate yellow light. Accordingly the colors are mixed together to produce white light to be radially emitted. The white light emitted toward the front opening of the reflecting mirror 14 can be projected by the projector type lens 15 forward while the shape thereof can be inverted horizontally and vertically. On the other hand, the white light emitted radially (except for that light directed toward the front opening direction), namely, the light emitted toward the reflecting mirror 14, as well as the blue light passing through the fluorescent member 13 can be reflected by the reflecting surface 14*b* of the reflecting mirror 14. The white light and blue light reflected by the reflecting surface 14*b* can be returned and impinge on the fluorescent member 13 again for light emission.

With this configuration, if the actuator 17 is driven to rotate the fluorescent member 13 into a position to match the A direction shown in FIG. 3A to the optical axis Ax, the light with the contour (or a shape of the image to be projected) of the fluorescent member 13 shown in FIG. 3B when viewed from arrow A can be projected through the projector type lens 15 while inverted vertically and horizontally by the projector type lens 15. As a result of this, a travelling beam in a high-beam light distribution pattern can be formed in front of the vehicle.

On the other hand, if the actuator 17 is driven to rotate the fluorescent member 13 by 90 degrees to a position to match the B direction shown in FIG. 3A to the optical axis Ax (the state shown in FIG. 1), the light with the contour (or a shape of the image to be projected) of the fluorescent member 13 shown in FIG. 3C when viewed from arrow B can be projected through the projector type lens 15 while inverted vertically and horizontally by the projector type lens 15. As a result of this, a passing-by beam in a low-beam light distribution pattern can be formed in front of the vehicle.

Accordingly, by rotating the fluorescent member 13, the contour (the shape of the image to be projected) of the fluorescent member 13 when viewed from the side of the projector type lens 15, namely, the shape of the light to be projected through the projector type lens 15 from the fluorescent member 13 can be changed. In this manner, at least two types of light distribution patterns including the high-beam and low-beam light distribution patterns can be switched.

Furthermore, the flexible mirror 12 can be moved vertically to change the irradiation region in the width direction by the blue light reflected upward by the flexible mirror 12. This means that the irradiated region of the fluorescent member 13 irradiated with the blue light can be changed in the width direction. As a result, the brightness distribution of white light that is emitted from the fluorescent member 13 can be changed. Accordingly, the light distribution pattern formed by the fluorescent member 13 through the projector type lens 15 can have different luminance distributions.

Specifically, when the blue light is concentrated around the center area of the fluorescent member 13 by narrowing the irradiation region by the blue light, the light distribution pattern that is formed can have a brighter center area and darker right and left areas. On the other hand, when the blur light is projected all over the fluorescent member 13 by widening the irradiation region by the blue light, the formed light distribution pattern can have an entirely uniform brightness area.

Accordingly, in the lighting unit with the above configuration, the light emission shape (the shape of the image to be projected) of the fluorescent member 13 to be projected through the projector type lens 15 can be changed by rotation of the fluorescent member 13. In this manner, at least two types of light distribution patterns including the high-beam and low-beam light distribution patterns can be switched without shielding the light from the LD 11 and only by rotating the fluorescent member 13.

Furthermore, the radius of curvature of the reflecting surface 12*a* for reflecting the blue light from the LD 11 can be changed by the movement of the flexible mirror 12. This can change the irradiation region of the blue light reflected by the flexible mirror 12 and projected to the fluorescent member 13. In this manner, the brightness distribution of white light that is emitted from the fluorescent member 13 can be changed by changing the irradiated region of the fluorescent member 13 by the blue light, thereby changing the luminance distribution of the light distribution pattern formed by the fluorescent member 13 through the projector type lens 15.

The white light emitted radially except for toward the front opening direction (toward the projection type lens 15), namely, toward the reflecting mirror 14, as well as the blue light passing through the fluorescent member 13 can be reflected by the reflecting surface 14*b* of the reflecting mirror 14. The reflected white light and blue light by the reflecting surface 14*b* can be returned and impinge on the fluorescent member 13 again. Accordingly, the light can be effectively utilized again for white light emission, thereby improving the luminous flux utilization efficiency.

In the lighting unit 1 of the presently disclosed subject matter, the blue light can be allowed to impinge on the fluorescent member 13 from below to cause the fluorescent member 13 to emit light in the front direction. Namely, the optical path (or optical axis) direction can be changed by means of the fluorescent member 13. Accordingly, even if the blue light being coherent light can pass the fluorescent member 13 without being diffused by the diffusion material contained in the fluorescent member 13, the blue light only reaches the reflecting surface 14*b* of the reflecting mirror 14 on the opposite side, thereby preventing the blue light from being projected directly through to the projection type lens 15 and to the outside. This configuration can ensure safety, with the blue light shielded accordingly.

A description will now be made to a lighting unit according to another exemplary embodiment.

Figure 5:
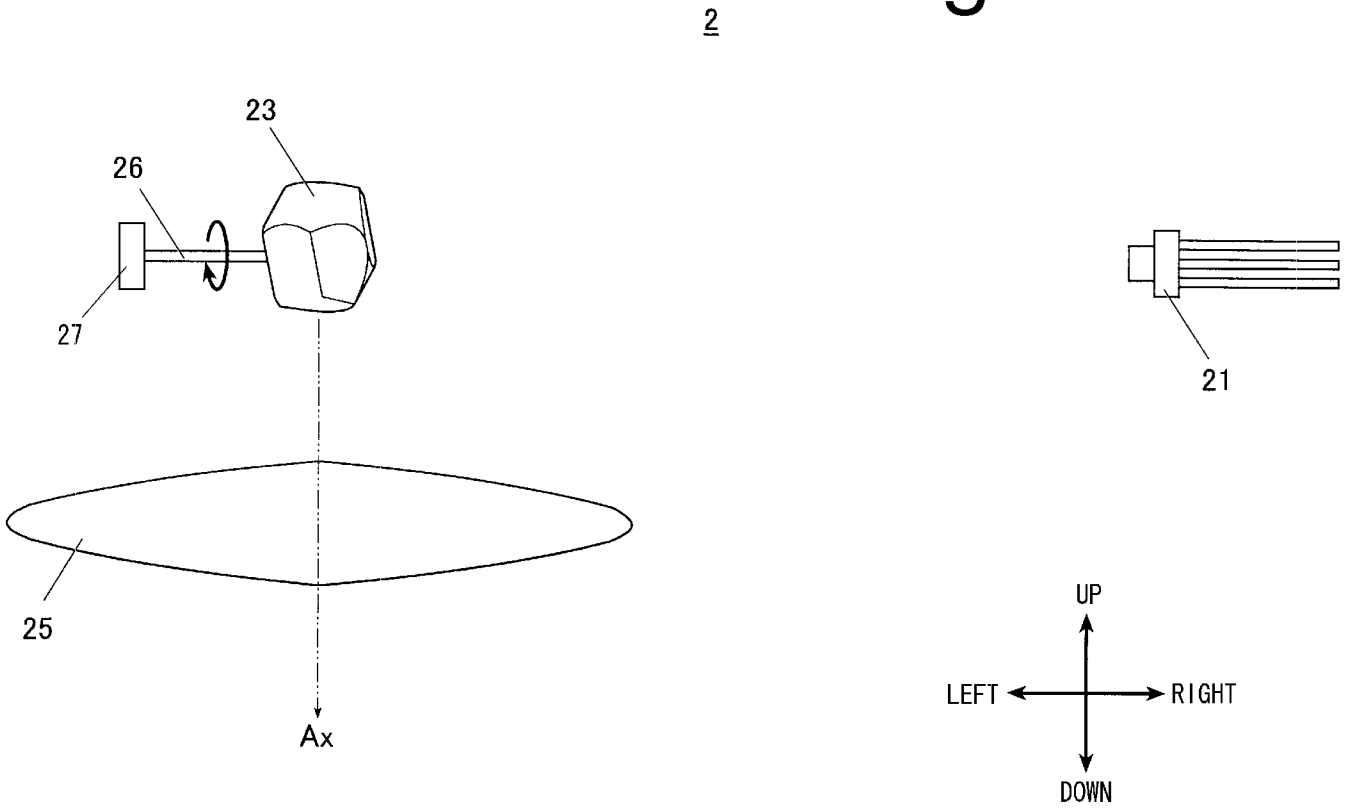
FIG. 5 is a side view showing portions of a lighting unit according to another exemplary embodiment made in accordance with principles of the presently disclosed subject matter.

FIG. 5 is a side view showing portions of a lighting unit 2 according to another exemplary embodiment made in accordance with principles of the presently disclosed subject matter.

The lighting unit 2 is an example in which the presently disclosed subject matter is applied to a general illuminating lamp for illuminating an interior of a room with light from above. The lighting unit 2 can include an LD 21, a fluorescent member 23, a projector type lens 23, a driving member (such as an actuator) 27, and the like.

In this exemplary embodiment, the LD 21 and the projector type lens 25 can be configured to be similar to the LD 11 and the projector type lens 15 in the first exemplary embodiment.

It should be noted that the LD 21 is disposed beside the fluorescent member 23 (for example, at a relatively farther position) to emit blue light that is directly used for illumination of the fluorescent member 23. The projector type lens 25 can have an optical axis Ax in the vertical direction, and can be disposed below the fluorescent member 23 so that the fluorescent member 23 can be positioned on the optical axis 23.

Figure 6A:
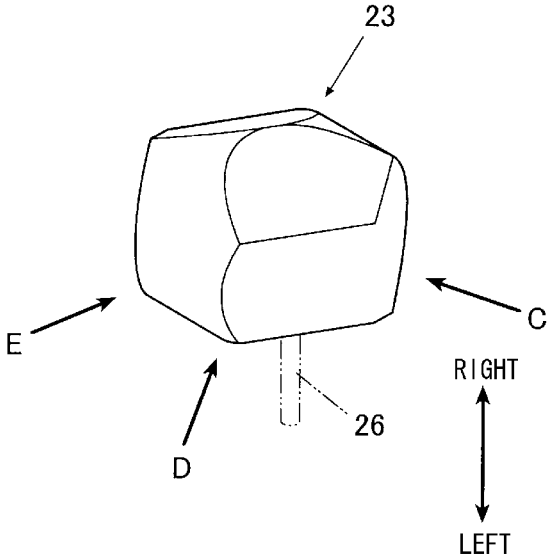
FIGS. 6A, 6B, 6C, and 6D are a perspective view of a fluorescent member in the lighting unit according to the exemplary embodiment of FIG. 5, a plan view when viewed from arrow C in FIG. 6A, a plan view when viewed from arrow D in FIG. 6A, and a plan view when viewed from arrow E in FIG. 6A, respectively.

FIGS. 6A, 6B, 6C, and 6D are a perspective view of a fluorescent member 23 of the lighting unit 2, a plan view when viewed from arrow C in FIG. 6A, a plan view when viewed from arrow D in FIG. 6A, and a plan view when viewed from arrow E in FIG. 6A, respectively.

As show in the drawings, the fluorescent member 23 can have a three-dimensionally specific shape such that, when viewed from the direction C perpendicular to the right-to-left direction, the contour (or a shape of the image to be projected) can be a circle, such that, when viewed from the direction D perpendicular to the right-to-left direction and C direction, the contour (or a shape of the image to be projected) can be a square with the paired opposite sides curved, and such that, when viewed from the direction E perpendicular to the right-to-left direction and forming an angle of approximately 60 degrees with the D direction, the contour (or a shape of the image to be projected) can be a hexagon. Herein, the dimension of the fluorescent member 13 can be a size such that the fluorescent member 13 is in contact with the inner wall of a cylinder with a 1 mm diameter and a 6 mm length, for example.

The fluorescent member 23 can be configured to be rotatable around its rotation shaft 26 extending in the right-to-left direction. The rotation axis 26 can be projected from the left end of the fluorescent member 23 to the left so that the extension line thereof passes the center of the fluorescent member 23. The other features of the rotation shaft 26 can be the same as those of the rotation shaft 16 of the first exemplary embodiment. The rotation shaft 26 can be configured to penetrate the fluorescent member 23, and in this case it is possible to fix the rotation shaft 26 not by an adhesive but by integrally mating and fitting it with the fluorescent member 23. In the present exemplary embodiment, the rotation shaft 26 can also function as a heat dissipation member.

In the lighting unit 2 with the above configuration, the LD 21 emits blue light (excitation light) so that the blue light impinges on the fluorescent member 23 and the fluorescent member can emit white light. The white light can be projected downward via the projector type lens 25.

Figure 6C:
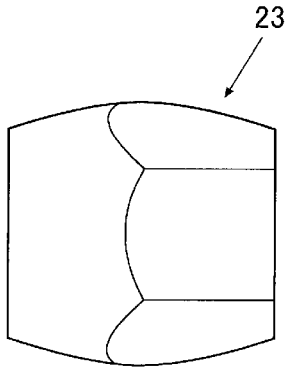
Figure 6B:
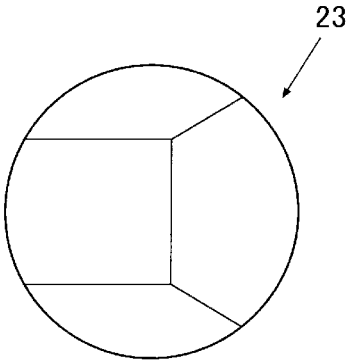

With this configuration, if the actuator 17 is driven to rotate the fluorescent member 23 to match the C direction shown in FIG. 6A to the optical axis Ax, the contour (or a shape of the image to be projected) of the fluorescent member 23 shown in FIG. 6B when viewed from arrow C can be projected through the projector type lens 25 so that a circular light distribution pattern can be formed downward.

On the other hand, if the actuator 27 is driven to rotate the fluorescent member 23 by 90 degrees to match the D direction shown in FIG. 6A to the optical axis Ax, the contour (or a shape of the image to be projected) of the fluorescent member 23 shown in FIG. 6C when viewed from arrow D can be projected through the projector type lens 25. As a result of this, an approximate square light distribution pattern can be formed below.

Figure 6D:
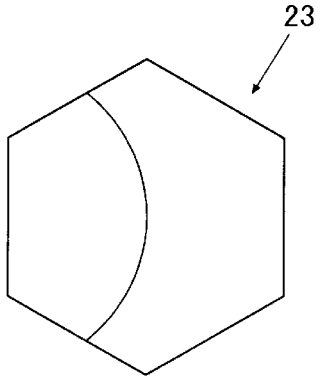

On the other hand, if the actuator 27 is driven to rotate the fluorescent member 23 by 60 degrees to match the E direction shown in FIG. 6A to the optical axis Ax, the light with the contour (or a shape of the image to be projected) of the fluorescent member 23 shown in FIG. 6D when viewed from arrow E can be projected through the projector type lens 25. As a result of this, a hexagonal light distribution pattern can be formed below.

Accordingly, as in the first exemplary embodiment, by rotating the fluorescent member 23, the contour (the shape of the image to be projected) of the fluorescent member 23 when viewed from the side of the projector type lens 25, namely, the shape of the light to be projected through the projector type lens 25 from the fluorescent member 23 can be changed. In this manner, a plurality of light distribution patterns can be switched without shielding the light from the LD 21 only by rotating the fluorescent member 23.

The LD 21 is disposed at a farther position from the fluorescent member 23 and, accordingly, the emission line of blue light from the LD 21 to the fluorescent member 23 can be utilized as stage effects. In addition, the white light emitted from the fluorescent member 23 to directions other than toward the projector type lens 25 and the blue light can also be utilized as stage effects by allowing them to be projected onto a ceiling, wall surfaces, and the like. When a higher luminance is required in the downward light distribution, a reflecting mirror around the fluorescent member as in the first exemplary embodiment can be provided.

The dimension of the fluorescent member 13 (23) is not limited to the above mentioned size or shape. However, the dimension of the fluorescent member can be as small as possible because a point light source is effective. However, too small of a dimension or shape may hinder the processability and the handleability. In view of this, it may be sized in a range of 1 mm to 30 mm in height, width and depth directions.

A description will now be made to a lighting unit according to yet another exemplary embodiment.

Figure 7:
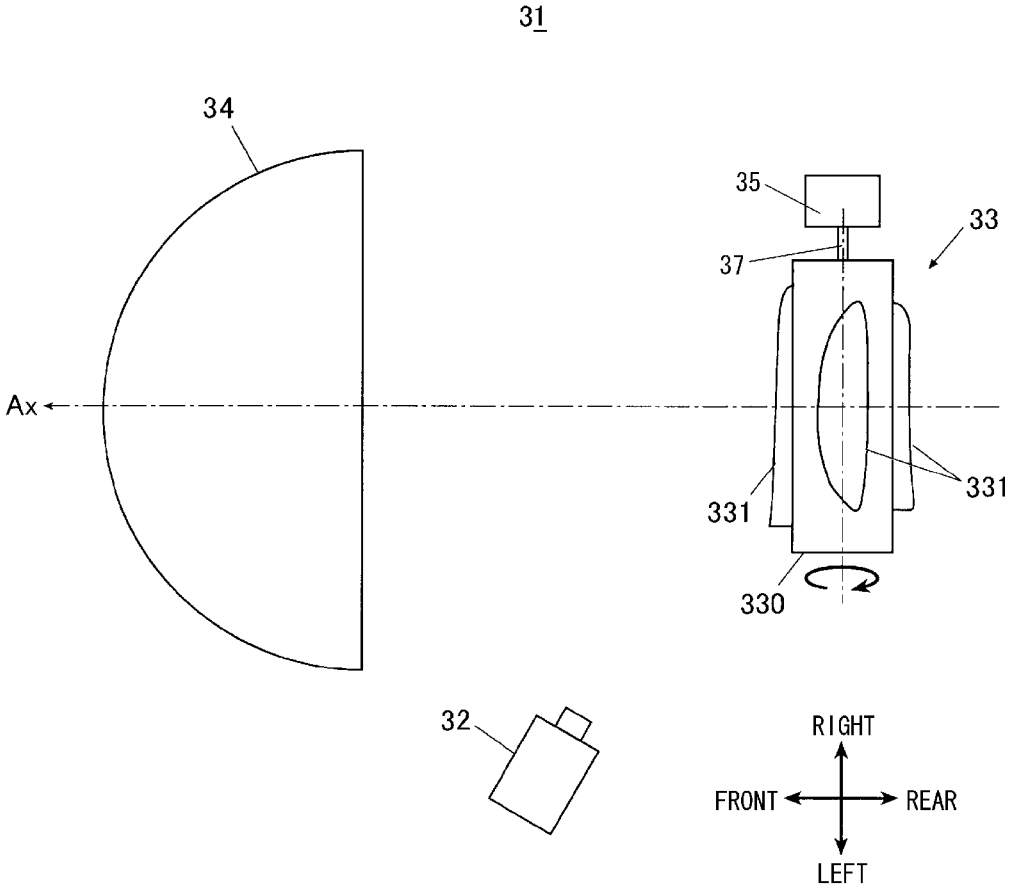
FIG. 7 is a plan view showing portions of a lighting unit (vehicle headlight) according to another exemplary embodiment made in accordance with principles of the presently disclosed subject matter.
Figure 8:
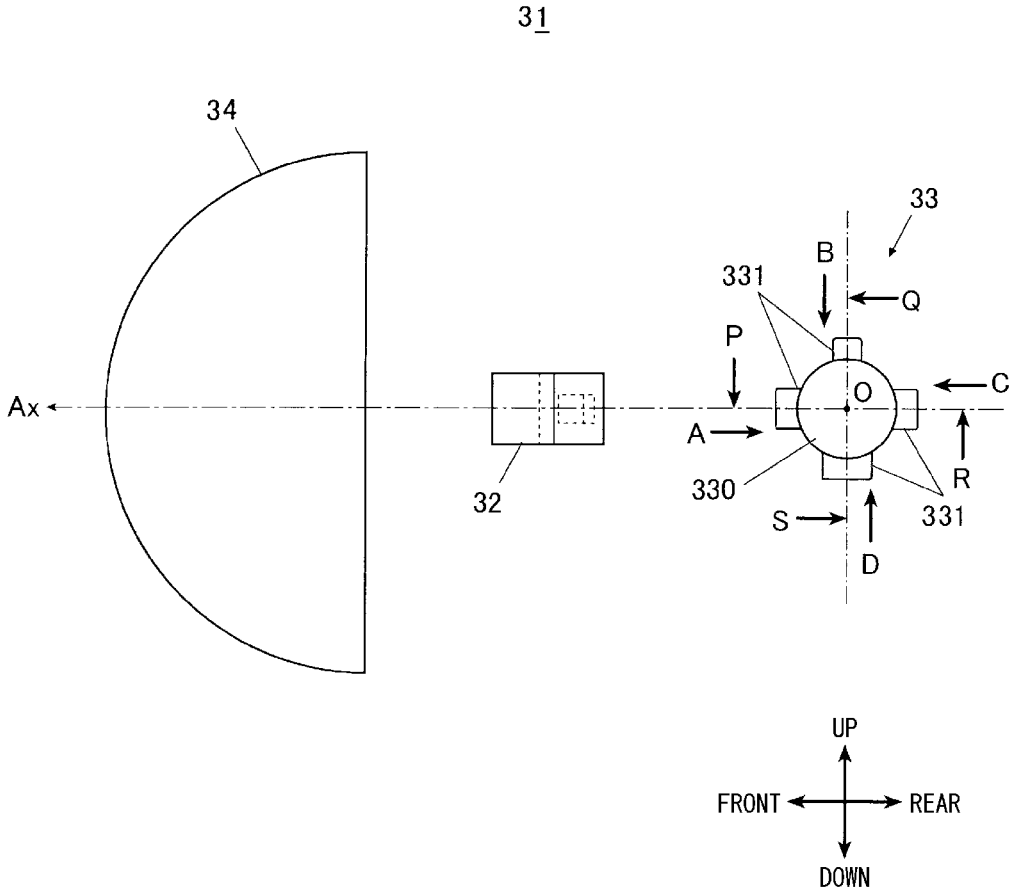
FIG. 8 is a side view of the lighting unit (vehicle headlight) according to the exemplary embodiment of FIG. 7.
Figure 9A:
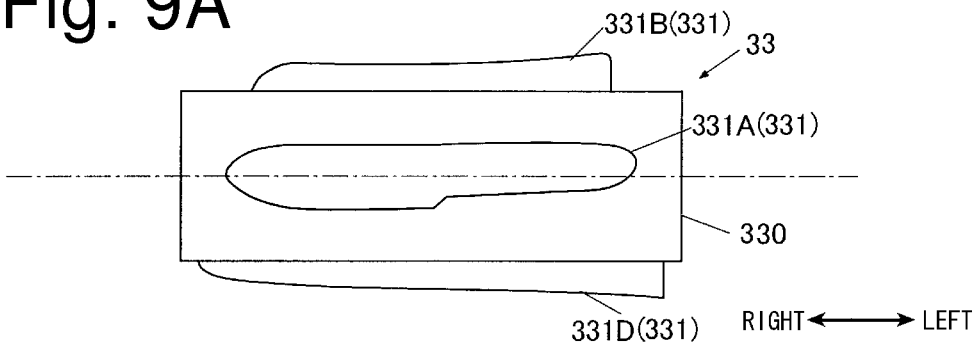
FIGS. 9A, 9B, 9C, and 9D are views when viewed from arrow A, arrow B, arrow C and arrow D in FIG. 8, respectively.
Figure 9B:
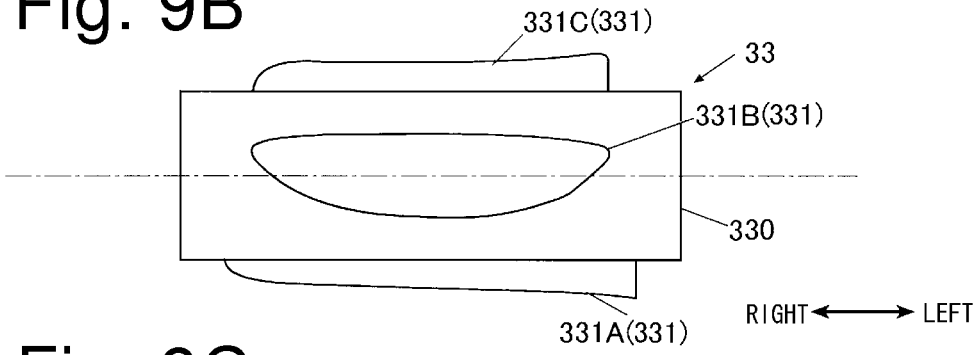
Figure 9C:
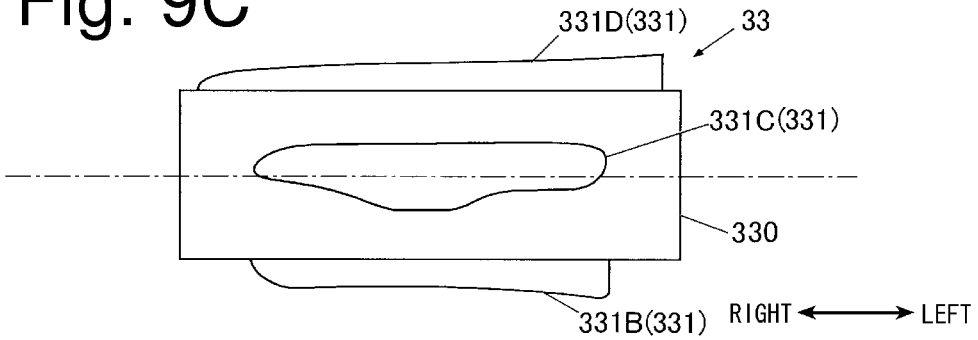
Figure 9D:
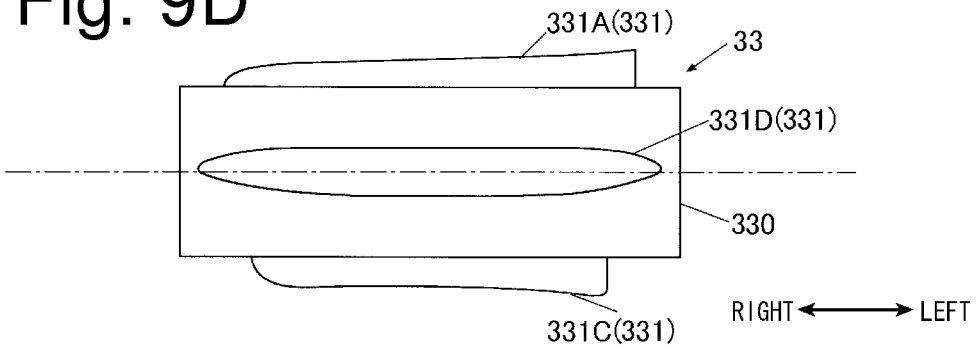
Figure 10A:
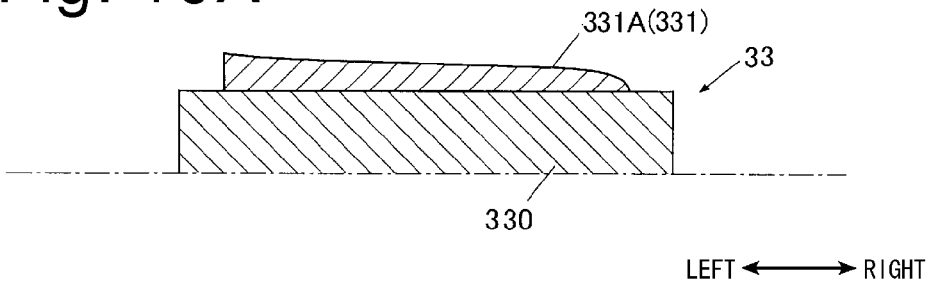
FIG. 10A, 10B, 10C, and 10D are cross-sectional views taken along line PO, line QO, line RO, and line SO in FIG. 8, respectively.
Figure 10B:
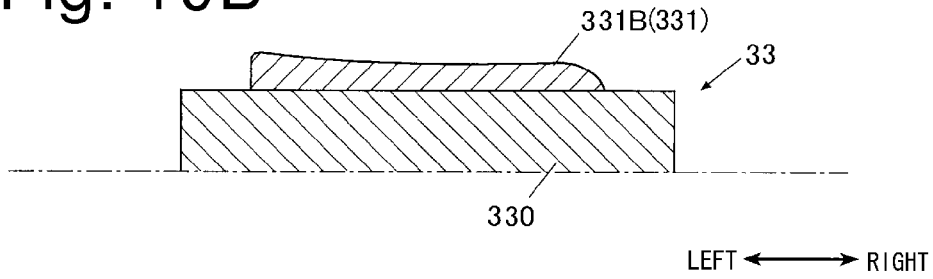
Figure 10C:
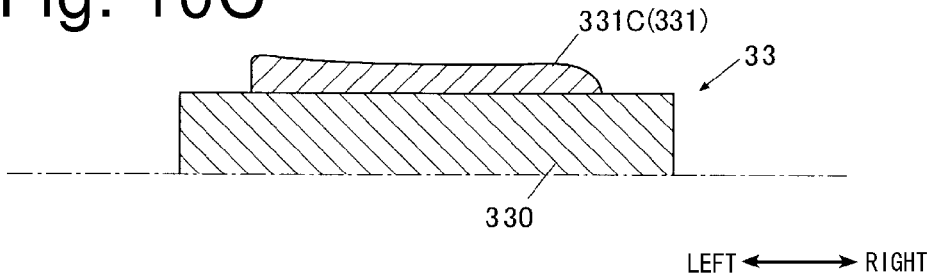
Figure 10D:
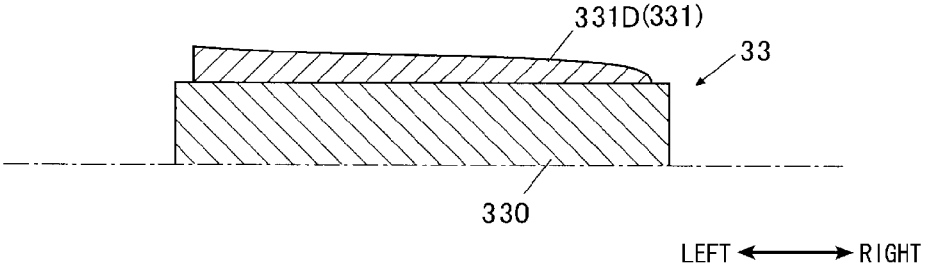

FIG. 7 is a plan view showing portions of a lighting unit (vehicle headlight) 31 according to the exemplary embodiment, and FIG. 8 is a side view of the lighting unit (vehicle headlight) 31.

As shown in the drawings, the vehicle headlight 31 can include an LD 32, a light emitting member 33, a projector type lens 34, a driving member (such as an actuator) 35, and the like.

The LD 32 can be a semiconductor light emitting device and, for example, can emit blue laser light toward the light emitting member 33 disposed obliquely right and rearward with respect to the LD 32. Specifically, the LD 32 can irradiate any one of fluorescent portions 331A to 331D facing towards the projector type lens 34 with the blue light, wherein the fluorescent portions 331A to 331D can be disposed on the peripheral surface of the light emitting member 33.

The light emitting member 33 can function as a fluorescent member as a light distribution control member configured to form a plurality of light distribution patterns.

The light emitting member 33 can include a cylindrical rotation member 330 extending in the right-to-left direction (width direction). The rotation member 330 can be configured to be rotatable around a rotation shaft 37 the end of which can be connected to the actuator 35 that can control the rotation angle thereof. It should be noted that the shape of the rotation member 330 is not limited to the cylinder, but any shape as long as it can be rotated.

The four fluorescent portions 331A to 331D can be disposed on the peripheral surface of the rotation member 330 in the peripheral direction at every 90 degrees as a center angle. These fluorescent portions 331A to 331D can be formed from a fluorescent material that can receive the blue light emitted from the LD 32 to be excited thereby and emit yellow light. Accordingly, when the fluorescent portion 331 (331A to 331D are collectively referred to as 331) receives the blue light, the blue light diffused by the fluorescent portion 331 (or diffusion material contained therein) and the yellow light emitted by the fluorescent portion 331 as a result of excitation can be mixed together. As a result of additive color mixing, the resulting white color light can be emitted radially. The fluorescent portions 331 can function as a light emitting surface (or function as a pseudo light source). Accordingly, they can be prepared by simply applying a fluorescent material onto the corresponding surface of the rotation member. Examples of the fluorescent material for use in the fluorescent portions 331 include a YAG (Yttrium Aluminum Garnet) with a rare earth added, and various common fluorescent materials.

FIGS. 9A, 9B, 9C, and 9D are views when viewed from arrow A, arrow B, arrow C and arrow D in FIG. 8, respectively, and FIG. 10A, 10B, 10C, and 10D are cross-sectional views taken along line PO, line QO, line RO, and line SO in FIG. 8, respectively. It should be noted that FIGS. 9A to 9D are views when seen from the respective front sides.

As shown in FIGS. 9A to 9D, the four fluorescent portions 331A to 331D can be formed as a first fluorescent portion 331A to a fourth fluorescent portion 331D each having a different front shape (a shape of an image to be projected) when viewed from its front side. Specifically, the first fluorescent portion 331A to fourth fluorescent portion 331D can be formed to be a different contour (a shape of an image to be projected) when viewed from its front side and provide similar figures to the respective shapes obtained by inverting the shapes of required light distribution patterns. Specifically, the contour (shape to be projected) of the first fluorescent portion 331A can be a figure similar to the shape obtained by inverting the shape of a low-beam light distribution; the contour (shape to be projected) of the second fluorescent portion 331B can be a figure similar to the shape obtained by inverting the shape of a high-beam light distribution; the contour (shape to be projected) of the third fluorescent portion 331C can be a figure similar to the shape obtained by inverting the shape of a highway running light distribution; and the contour (shape to be projected) of the fourth fluorescent portion 331D can be a figure similar to the shape obtained by inverting the shape of an urban zone traveling light distribution.

As shown in FIGS. 10A to 10D, the first to fourth fluorescent portions 331A to 331D can each have a recess and/or a convex. This surface recess and/or convex can determine the luminance distribution of the light distribution pattern formed by the white light from each fluorescent portion 331.

Figure 11:
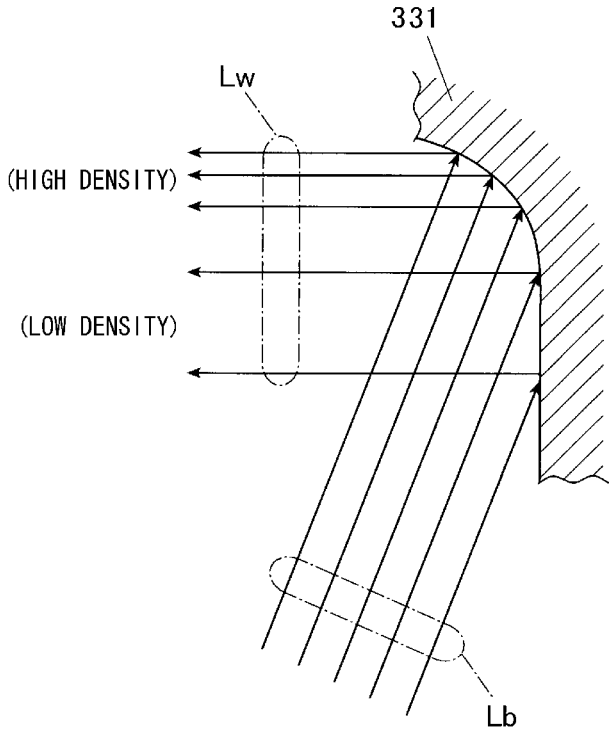
FIG. 11 is a partial cross-sectional view of the fluorescent portion illustrating the light density distribution of light emitted from the surface of the fluorescent portion.

Specifically, as shown in FIG. 11, each fluorescent portion 331 can have a surface with a recess and/or a convex so that the blue light Lb from the LD 32 can impinge by a sharper angle on a portion of the surface from which higher density white light Lw is emitted to be brighter. Accordingly, the surface of each of the first to fourth fluorescent portions 331A to 331D can have a recess and/or a convex so that the blue light from the LD 32 can impinge by a sharper angle on a portion of the surface from which white light is emitted to form part of the light distribution pattern with higher luminance required. Specifically, the recess and/or convex can be provided so that the surface of the first fluorescent portion 331A can correspond to the luminous intensity of the low-beam light distribution, the surface of the second fluorescent portion 331B can correspond to the luminous intensity of the high-beam light distribution, the surface of the third fluorescent portion 331C can correspond to the luminous intensity of the high-speed running light distribution, and the surface of the fourth fluorescent portion 331D can correspond to the luminous intensity of the urban zone traveling light distribution.

The projector type lens 34 can be a plano-convex lens with a front convex surface and have an optical axis Ax in the front-to-rear direction, on which the light emission member 33 (rotation member 330) is positioned. The projector type lens 34 can be disposed in front of the fluorescent member 33. The projector type lens 34 can have a rear focal point positioned at or near the fluorescent portions 331. With this configuration, the white light emitted from the fluorescent portion 331 forward can be projected forward through the projector type lens 34 while the shape of the image of the fluorescent portion 331 is inverted vertically and horizontally by the projector type lens 34.

FIGS. 12A, 12B, 12C, and 12D are diagrams showing light distribution patterns that can be formed by the lighting unit (vehicle headlight) 31 when viewed from the vehicle side, respectively. FIGS. 13A, 13B, 13C, and 13D are diagrams showing the light distribution patterns that can be formed by the lighting unit (vehicle headlight) 31 when viewed above, respectively.

In the vehicle headlight 31 with this configuration, the blue light emitted from the LD 32 can be projected onto the fluorescent portion 331 facing to the projector type lens 34, and white light emitted from the fluorescent portion 331 by the color additive mixing of blue light and yellow light forward can be projected forward through the projector type lens 34 while the shape of the image of the fluorescent portion 331 is inverted vertically and horizontally by the projector type lens 34.

Figure 12A:
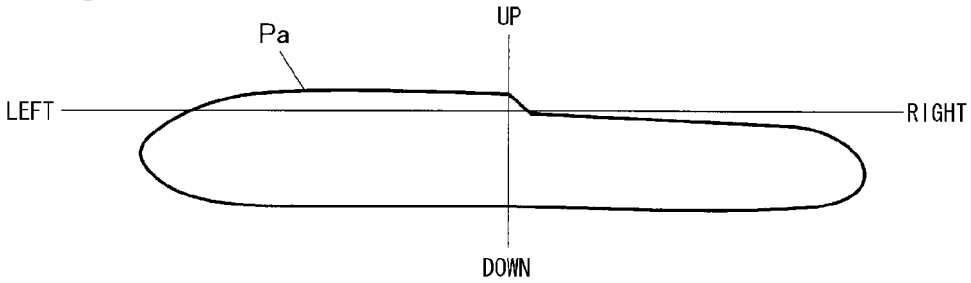
FIGS. 12A, 12B, 12C, and 12D are diagrams showing light distribution patterns that can be formed by the lighting unit (vehicle headlight) when viewed from the vehicle side, respectively.
Figure 13A:
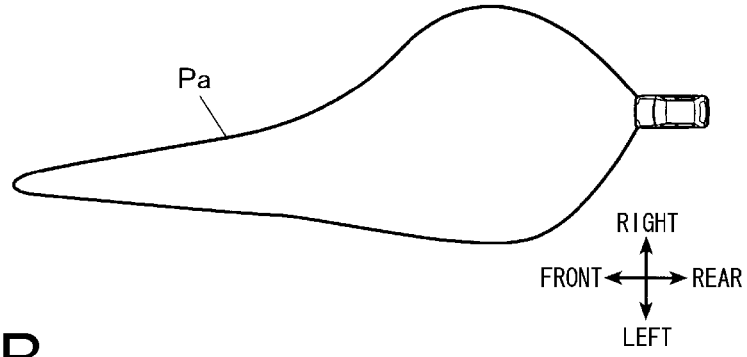
FIGS. 13A, 13B, 13C, and 13D are diagrams showing the light distribution patterns that can be formed by the lighting unit (vehicle headlight) when viewed above, respectively.

In this case, when the first fluorescent portion 331A is caused to face towards the projector type lens 34 by the driving control of the actuator 35, the contour (shape of the image to be projected) of the first fluorescent portion 331A is inverted vertically and horizontally by the projector type lens 34 with the brightness distribution corresponding to the surface recess and/or convex of the first fluorescent member 331A. Accordingly, as shown in FIGS. 12A and 13A, the low beam (passing-by beam) Pa can be projected in front of the vehicle with the light distribution pattern obtained by vertically and horizontally inverting the contour (the shape of the image to be projected) of the first fluorescent portion 331A and with the luminance distribution corresponding to the surface recess and/or convex of the first fluorescent portion 331A.

Figure 12B:
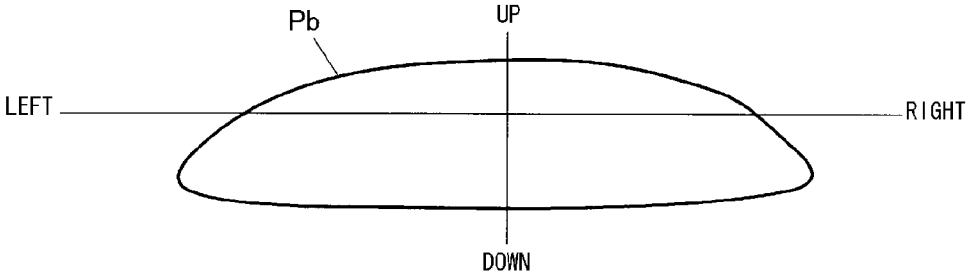
Figure 13B:
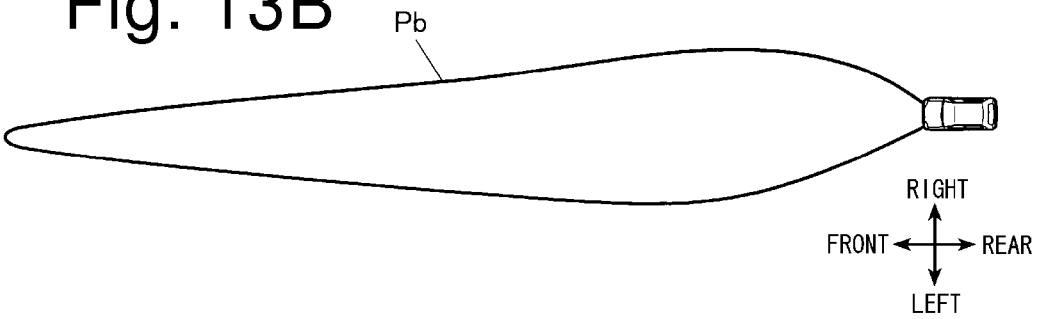

When the second fluorescent portion 331B is caused to face towards the projector type lens 34 by the driving control of the actuator 35, the contour (shape of the image to be projected) of the second fluorescent portion 331B is inverted vertically and horizontally by the projector type lens 34 with the brightness distribution corresponding to the surface recess and/or convex of the second fluorescent portion 331B. Accordingly, as shown in FIGS. 12B and 13B, the high beam Pb can be projected in front of the vehicle with the light distribution pattern obtained by vertically and horizontally inverting the contour (the shape of the image to be projected) of the second fluorescent portion 331B and with the luminance distribution corresponding to the surface recess and/or convex of the second fluorescent portion 331B.

Figure 12C:
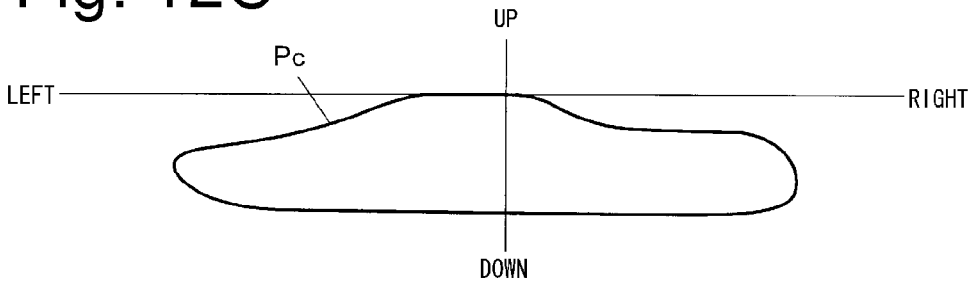
Figure 12D:
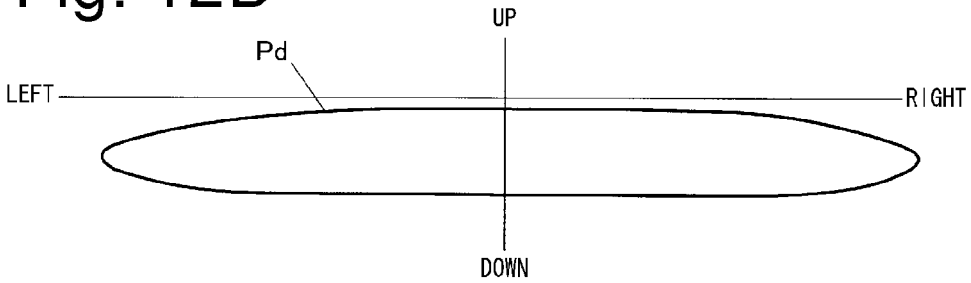
Figure 13C:
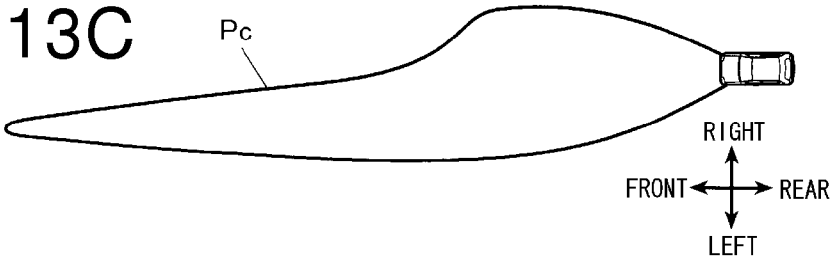
Figure 13D:
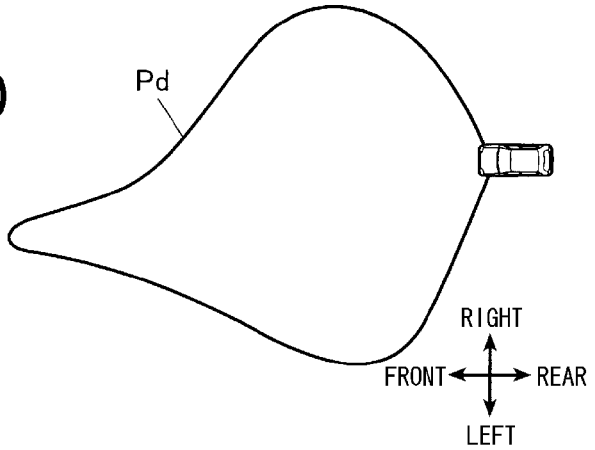

In the same manner, when the third fluorescent portion 331C is caused to face towards the projector type lens 34 by the driving control of the actuator 35, the highway running beam Pc can be projected in front of the vehicle as shown in FIGS. 12C and 13C. Furthermore, when the fourth fluorescent portion 331D is caused to face towards the projector type lens 34 by the driving control of the actuator 35, the urban zone traveling beam Pd can be projected in front of the vehicle as shown in FIGS. 12D and 13D.

In the vehicle headlight 31 with the above configuration, the light emitting member 33 (rotation member 330) is driven by the actuator 35 to rotate and thereby change the projected image by switching the fluorescent portions 331 that face towards the projector type lens 34. Thus, the shape of light projected from the projector type lens 34 can be changed. According to the configuration described above, a plurality of light distribution patterns can be formed only by rotating the rotation member 330 of the light emitting member (fluorescent member) 33 by a predetermined angle and without shielding the light from the LD 32.

Furthermore, the surface of each fluorescent portion 331 can have a recess and/or a convex so that the blue light from the LD 32 can impinge by a sharper angle on a portion of the surface from which white light is emitted to form part of the light distribution pattern with higher luminance, as desired. With this configuration, a light distribution pattern with the luminance distribution corresponding to the surface recess and/or convex of the fluorescent portion 331 can be formed. This means a light distribution pattern with a desired luminance distribution can be formed simply by appropriately shaping the surface of the fluorescent portion 331.

In the above exemplary embodiments, the semiconductor light emitting device of the presently disclosed subject matter is a laser diode as one example, or it may be a light emitting diode. In view of light-gathering performance to the fluorescent portion, a laser diode is effective in such applications. Furthermore, the light emitted from the LD may be collimated with respect to the fluorescent portion.

The fluorescent portion may contain a diffusion material configured to diffuse the light emitted from the LD, and examples thereof include calcium carbonate, titanium oxide, alumina, and the like. In this case, although the fluorescent material and the diffusion material can be mixed together with a binder resin or the like, they can be integrated by sintering to provide high durability and heat resistance.

In the above exemplary embodiments, the LD can emit blue light and the fluorescent portion can emit yellow light by the excitation with the blue light, but these structures are not limited thereto, and other combinations of color of excitation light and fluorescent material can be employed for emitting white light or other colored light. For example, the excitation light can be blue light and fluorescent materials emitting red light and green light respectively can be used. As another example, the excitation light is UV light and fluorescent materials emitting red light, green light, and blue light respectively can be used. In this case, in order to prevent the UV light from leaking, the fluorescent member may not contain a diffusion material. The dimension of the fluorescent portion can be as small as possible because a point light source is very effective. However, too small of a dimension may hinder the processability and the handleability. In view of this, the fluorescent portion may be sized in a range of 1 mm to 30 mm in height, width and depth directions.

The fluorescent portion can change the brightness of light emitted therefrom by the density of the fluorescent material and/or the diffusion material constituting the fluorescent portion. For example, when the density at the center of the fluorescent portion is made high, the brightness thereat can be increased accordingly. In this manner, the luminance distribution of the desired light distribution pattern can be controlled by adjusting the density distribution of the fluorescent material and/or diffusion material of the fluorescent portion.

Furthermore, the contour (the shape of the image to be projected) of the fluorescent portion/member can be varied continuously by the rotation or discontinuously set as in the above exemplary embodiments. In the continuous variation, the fluorescent member can be driven by the driving member to rotate continuously or intermittently, thereby freely providing required light distribution patterns (i.e., a constantly changing light distribution pattern).

Examples of the driving member include a hydraulic actuator, a pneumatic actuator, a motor, a linkage, a stepper, and the like mechanism that can drive and control a rotating member.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lighting unit comprising:

a light source including a semiconductor light emitting device;

a fluorescent member including a fluorescent portion configured to receive part of or all of light emitted from the light source and to emit visible light with a predetermined color;

a projector type lens having an optical axis intersecting with the fluorescent member, the projector type lens configured to project the visible light emitted from the fluorescent member forward in a direction of the optical axis; and a driving member connected to the fluorescent member and configured to rotate the fluorescent member around a rotation shaft substantially perpendicular to the optical axis of the projector type lens, wherein the fluorescent member is shaped such that when the fluorescent member is rotated by a predetermined angle from a first position to a second position by the driving member and viewed from the projector type lens, a plurality of contours of the fluorescent portion projected by the projector type lens are changed in accordance with the predetermined angle.

2. The lighting unit according to claim 1, wherein the fluorescent member is mainly composed of the fluorescent portion, and when the fluorescent member is rotated by the predetermined angle around the rotation shaft of the fluorescent member, the fluorescent member receives the light from the light source and emits light with the contour of the fluorescent portion at the predetermined angle position for projection, thereby forming a plurality of light distribution patterns.

3. The lighting unit according to claim 1, further comprising a flexible mirror configured to move in a predetermined moving direction, the flexible mirror having a variable reflecting surface with a surface having a variable radius of curvature varied in the moving direction, the flexible mirror disposed on a light path from the light source to the fluorescent member so that light emitted from the light source is reflected by the variable reflector to the fluorescent member.

4. The lighting unit according to claim 2, further comprising a flexible mirror configured to move in a predetermined moving direction, the flexible mirror having a variable reflecting surface with a surface having variable radius of curvature varied in the moving direction, the flexible mirror disposed on a light path from the light source to the fluorescent member so that light emitted from the light source is reflected by the variable reflector to the fluorescent member.

5. The lighting unit according to claim 3, further comprising a reflecting mirror disposed around the fluorescent member except for a portion where the visible light from the fluorescent member travels to the projector type lens, and having a reflecting inner surface concentric with the fluorescent member.

6. The lighting unit according to claim 4, further comprising a reflecting mirror disposed around the fluorescent member except for a portion where the visible light from the fluorescent member travels to the projector type lens and having a reflecting inner surface concentric with the fluorescent member.

7. The lighting unit according to claim 1, wherein the fluorescent member includes a plurality of the fluorescent portions with respective different shapes disposed at a plurality of angle positions around the rotation shaft of the fluorescent member, and when the fluorescent member is rotated around the rotation shaft at one of the plurality of angle positions so that a corresponding one of the fluorescent portions faces towards the projector type lens, the corresponding fluorescent portion receives light from the light source and emits light so that light with a contour of the corresponding fluorescent portion at that angle position is projected to provide a corresponding light distribution pattern.

8. The lighting unit according to claim 7, wherein the plurality of fluorescent portions have respective surfaces with a recess and/or a convex so that the light from the light source impinges by a sharper angle on a portion of the surface from which light is emitted to form part of the light distribution pattern with higher luminance.

9. The lighting unit according to claim 1, wherein the semiconductor light emitting device is a laser diode.

10. The lighting unit according to claim 2, wherein the semiconductor light emitting device is a laser diode.

11. The lighting unit according to claim 7, wherein the semiconductor light emitting device is a laser diode.

12. The lighting unit according to claim 8, wherein the semiconductor light emitting device is a laser diode.

13. The lighting unit according to claim 1, wherein the fluorescent member includes a diffusion material.

14. The lighting unit according to claim 2, wherein the fluorescent member includes a diffusion material.

15. The lighting unit according to claim 7, wherein the fluorescent member includes a diffusion material.

16. The lighting unit according to claim 8, wherein the fluorescent member includes a diffusion material.

17. The lighting unit according to claim 1, wherein the lighting unit is a vehicle headlight.

18. The lighting unit according to claim 2, wherein the lighting unit is a vehicle headlight.

19. The lighting unit according to claim 7, wherein the lighting unit is a vehicle headlight.

20. The lighting unit according to claim 8, wherein the lighting unit is a vehicle headlight.

21. The lighting unit according to claim 16, wherein the lighting unit is a vehicle headlight.

22. The lighting unit according to claim 1, wherein different ones of the contours of the fluorescent member correspond to a low-beam light distribution pattern and a high-beam light distribution pattern for a vehicle headlight.

23. The lighting unit according to claim 2, wherein different ones of the contours of the fluorescent member correspond to a low-beam light distribution pattern and a high-beam light distribution pattern for a vehicle headlight.

24. The lighting unit according to claim 7, wherein different ones of the contours of the fluorescent member correspond to a low-beam light distribution pattern and a high-beam light distribution pattern for a vehicle headlight.

25. The lighting unit according to claim 8, wherein different ones of the contours of the fluorescent member correspond to a low-beam light distribution pattern and a high-beam light distribution pattern for a vehicle headlight.

* * * * *